US007758655B2

(12) United States Patent
Clemens

(10) Patent No.: US 7,758,655 B2
(45) Date of Patent: Jul. 20, 2010

(54) METHOD FOR CREATING COLORED SOCKS TO MATCH A SUIT

(76) Inventor: Curtis Clemens, 7922 Windsor Ct., Darien, IL (US) 60561

( * ) Notice: Subject to any disclaimer, the term of this patent is extended or adjusted under 35 U.S.C. 154(b) by 1132 days.

(21) Appl. No.: 11/273,007

(22) Filed: Nov. 14, 2005

(65) Prior Publication Data

US 2007/0118995 A1 May 31, 2007

(51) Int. Cl.
*D06M 23/00* (2006.01)

(52) U.S. Cl. ..... 8/115.51; 8/148; 8/150; 382/162

(58) Field of Classification Search ..... 8/94.1 R, 8/115.51, 916, 920, 148, 150; 382/162
See application file for complete search history.

(56) References Cited

U.S. PATENT DOCUMENTS

| | | | | |
|---|---|---|---|---|
| 3,429,727 | A * | 2/1969 | Hochberg | 427/209 |
| 3,688,348 | A | 9/1972 | Klotz et al. | |
| 4,058,853 | A | 11/1977 | Boxer et al. | |
| 4,833,747 | A | 5/1989 | Yokeley | |
| 4,965,902 | A | 10/1990 | Mazzoli | |
| 5,288,322 | A * | 2/1994 | Hanna et al. | 118/33 |
| 2002/0037364 | A1* | 3/2002 | Fleming | 427/162 |
| 2003/0156752 | A1* | 8/2003 | Turpin et al. | 382/162 |
| 2006/0169783 | A1* | 8/2006 | Gagne | 235/487 |
| 2006/0255939 | A1* | 11/2006 | Spector | 340/568.1 |
| 2007/0059844 | A1* | 3/2007 | Harper et al. | 436/518 |
| 2007/0263249 | A1* | 11/2007 | Rich et al. | 358/1.15 |

OTHER PUBLICATIONS

Smith, Leslie C. "You should match your socks to dominant color in ensemble." The Ottawa Citizen. Ottawa, Ont. Feb. 3, 1994, p. G2.*
Fenton, Louis. "Socks now match pants or shoes." Richmond Times—Dispatch. Richmond, VA, Nov. 22, 1998, p.F6.*

* cited by examiner

*Primary Examiner*—Lorna M Douyon
*Assistant Examiner*—Tri V Nguyen
(74) *Attorney, Agent, or Firm*—Buskop Law Group, P.C.; Wendy Buskop

(57) ABSTRACT

Methods for coloring socks to match suits, trousers, or shoes involves identifying a dye specification for suit material, trouser material or shoe material. The suit, slacks, or shoe material can be dyed per the dye specification. The dye specification can be transmitted to a sock manufacturing site. The methods continue by dyeing sock material with the dye specification to match the dyed suit material, the dyed shoe material, or dyed trouser material. For the suit materials and trouser materials, the suit or slacks are formed and dye specifications can be placed in a pocket of the resulting garment for future sock ordering. For the shoe embodiment, the dye specification can be placed in the shoes. A pair of socks can be formed from the dyed sock material, and the dyed socks can be connected to the respective manufactured article to form a sock/suit, sock/trouser or sock/shoes unit.

15 Claims, 1 Drawing Sheet

METHOD FOR CREATING COLORED SOCKS TO MATCH A SUIT

FIELD

The present embodiments generally relate to methods for creating socks in a manner of keeping pairs of socks together with the same colored suit and allowing a pair of socks to be easily and visually matched to a suit and a pair of shoes.

BACKGROUND

Matching up socks to a suit is a rather tedious job. Various solutions have been proposed in response to simply matching socks, but not for matching socks to a suit. Boxer U.S. Pat. No. 4,058,853, shows socks secured to one another using hook and loop fasteners secured to the tops of each of the socks. In Klotz U.S. Pat. No. 3,688,348, a band with hook and loop fasteners is used to secure socks to one another. Connecting socks to a matching suit has not occurred.

Identifying socks belonging to specific suits or other clothing poses a significant challenge. Socks are typically made from similar fabric and are of dark and closely contrasting colors. This coloring makes matching dark socks with dark suits a difficult task. With multiple members in the family unit, the difficulty increases because of the need to establish ownership of the socks, especially these days when socks are marketed in "one size fits all." The problem is compounded where there can be more than one pair of socks of a given color. Unless means exists to identify socks constituting like pairs and then matching to a suit or clothing of the appropriate color, the socks can be mismatched as to ownership, color, or original pairing. Usually, the mismatch is discovered when the wearer is in situations that can cause great embarrassment.

A need exists for a manner of matching of socks to shoes and suits.

The present embodiments meet these needs of providing matched socks to suits and also matched socks to shoes.

BRIEF DESCRIPTION OF THE DRAWINGS

The detailed description will be better understood in conjunction with the accompanying drawings as follows.

Figure 1:
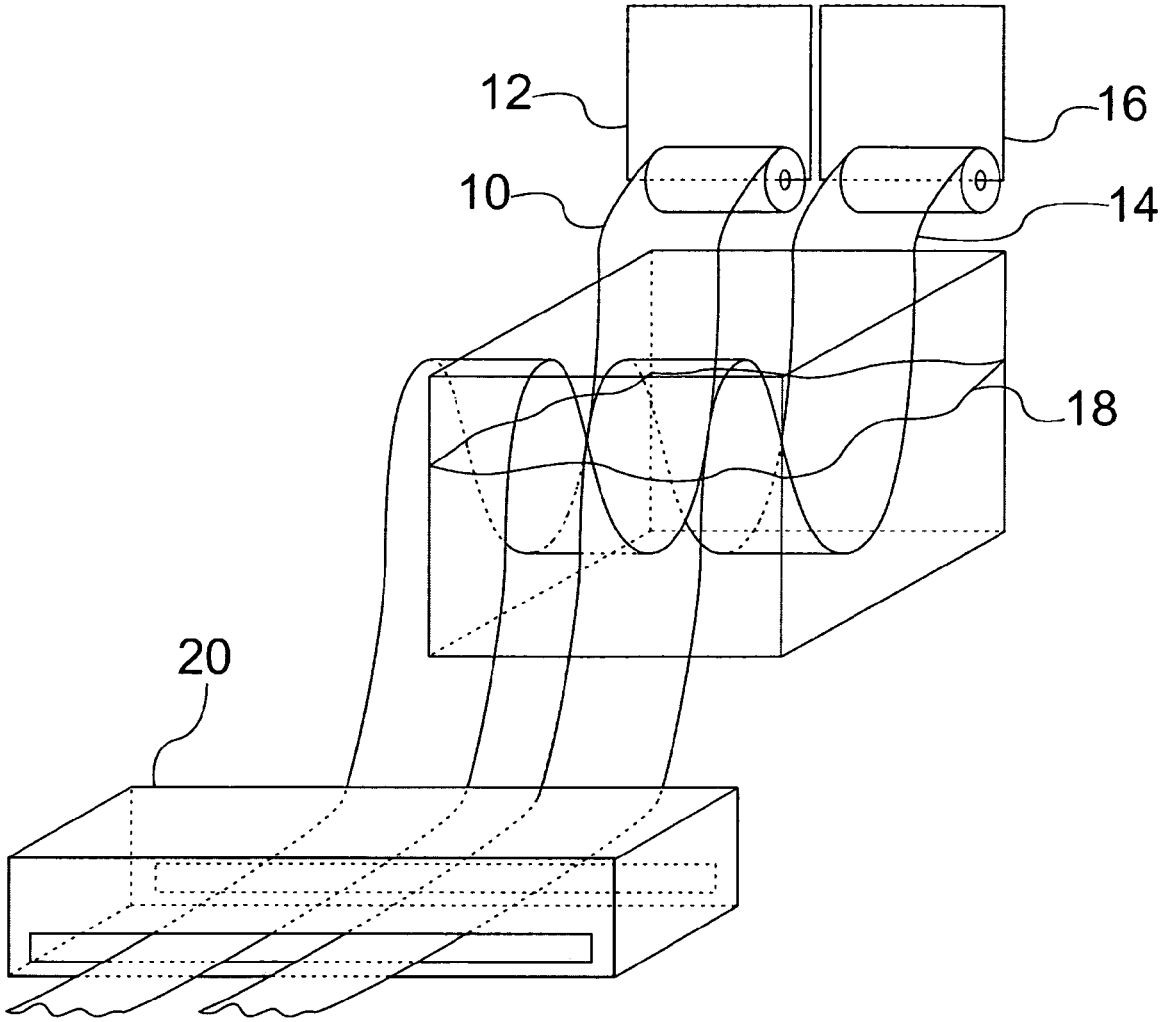
FIG. 1 depicts a top perspective view of sock material and suit material to be dyed in a common dye bath prior to forming into the sock/suit pair.

The present embodiments are detailed below with reference to the listed Figures.

DETAILED DESCRIPTION OF THE EMBODIMENTS

Before explaining the present embodiments in detail, it is to be understood that the embodiments are not limited to the particular embodiments and that they can be practiced or carried out in various ways.

The present embodiments are generally related to methods by which pairs of socks are created to match the dyed specifications used for a suit or for trousers, or for a pair of shoes.

One embodiment of the invention contemplates that a pair of socks can be formed with identical dye specifications as the fabric of a suit, such as a business suit, or a tuxedo, or even a safety suit, such as ones used in chemical plants.

Another embodiment of the invention contemplates that a pair of socks can be formed with identical dye specifications as the fabric for a pair of trousers, or pants, such as tuxedo trousers, dress trousers, or business suit trousers.

Yet another embodiment of the invention contemplates that a pair of socks can be formed with identical dye specifications as a dyed color to match a pair of shoes, such as dress shoes, business shoes, or casual shoes.

In discussing the suit/sock embodiment, suits can mean business suits, with or without matching business pants, with or without matching vests, tuxedos, with or without cummerbunds, and combinations thereof. The suit can be a safety suit, also.

The present embodiments contemplate that a suit, trouser, or shoe material can be placed in a dye bath using dye with a specific dye specification. The dye specification is the precise color dye of the fabric of the suit, fabric of the trouser or shoe material, given the weight of the fabric and the material content of the fabric which can be leather.

The dye specification can be transmitted to a sock manufacturing site. At the sock manufacturing site, the dye specification can be used to make an identical dye solution for creating an identical dye bath for a given sock material. The sock material is then placed in the dye bath and dyed to precisely match the dyed suit material, the dyed trouser material, or the dyed shoe material. Alternatively, the identical dye solution for the dye specification can be delivered to a suit manufacturer, a trouser manufacturer, or a shoe manufacturer for dyeing additional apparel, respectively.

Then, the suit can be formed from the dyed suit material, and the dye specifications can be attached to the suit in some manner, such as in the pocket for the suit.

The shoes are formed from the dyed shoe material, and the dye specifications can be attached to the shoes in some manner, such as inside one shoe.

The trousers can be then formed from the dyed trouser material, and the dye specifications can be attached to the trousers in some manner, such as in the pocket of the trouser.

The dye specifications can be placed on a label or can be included inside the pocket of the suit, inside the pocket of the trouser, or inside one shoe for future sock ordering by a user.

An order form to allow for future ordering, by a user, of additional sock pairs dyed with the dye specifications for the suit, the trousers, or the shoes can be included with the suit, the trousers, or the shoes, such as inside the pocket for the suit, inside the pocket for the trouser, or inside one shoe, respectively.

A pair of socks can be formed from the dyed sock material. The dyed socks can be connected to the suit, the trousers, and the shoes, forming a matching sock/suit unit for the sock/suit embodiment, a matching sock/trouser unit for the sock/trouser embodiment, or a matching sock/shoe unit for the sock/shoe embodiment.

The methods can allow for the socks to be paired prior to the purchase of a suit, trouser, or pair of shoes so that the pairs of socks can be identified easily and quickly, even after frequent use.

With reference to the figures, FIG. 1 depicts an apparatus that can be used to carry out the method of the suit/sock embodiment. In this top perspective view, sock material and suit material are dyed in a common dye bath prior to forming into the socks or the suit, respectively.

In FIG. 1, sock material 10, which can be between 6 feet and 18 feet long, is shown mounted to a first hanger roller assembly 12 for dyeing. Suit material 14, which can be between 6 feet and 18 feet long, can be mounted to a second hanger roller assembly 16 for dyeing.

The material 10 and 14 from both hanger roller assemblies 12 and 16 can be unwound and passed through a liquid dye bath 18 which is at ambient temperature. The material can be passed into a dryer 20 for drying, or it can be left to dry in ambient conditions. The dried material is then subsequently cut and sewed into the intended garment, socks from the sock material 10 and a suit from the suit material 14.

The present embodiments include processes for coloring or dyeing socks to match suits that can utilize the device depicted in FIG. 1. The process involves identifying a dye specification for material 14 which can be wool, cotton, silk, nylon, or combinations thereof in the case of suits or trousers and leather in the case of shoes, or other man made materials, such as nylon blends. The material 14 can be dyed using a specific dye specification.

In another embodiment, the sock material can be dyed, and socks can be made at a location different from that of the suits, trousers and shoes. Then, the dye specification can be transmitted to a sock manufacturing site from the location where the shoe leather is dyed, the suit material is dyed, or the trouser material is dyed.

A dye bath 18 can be designed and created which enables sock material 10 to be dyed to match the dye specification of the suit, trouser or shoe material to which it corresponds and, therefore, creates sock material 10 that identically matches the dyed suit material 14. The dye bath can include fixers and/or other additives to speed the dyeing process.

The embodied processes can be used to create pant/sock combinations, which can be termed slack/sock combinations or trouser/sock combinations, suit/sock combinations, and shoe/sock combinations.

The socks can be a variety of socks, including nylon socks, silk socks, cotton socks, wool socks, cotton and wool blend socks, nylon and cotton blend socks, silk and cotton blend socks, and other combinations thereof. The socks can be an elastomeric blend or safety socks. The suit material can be made from wool, nylon, polyester, silk, leather, cotton, cashmere, blends thereof, and other combinations thereof. The suit material can be made of a safety suit fabric, such as Nomex™.

The dye can be fabric or leather dye such as Procion™ dye. Other dyes can be used as well. The dye bath 18 can be a solution of 80% water and 18% dye and 2% other fixative or additive used in a fabric or leather dyeing process. The size of the dye bath can be generally in a range between 50 gallons and 300 gallons of liquid. The sock and suit materials are contemplated to soak in the dye bath for a range between one minute and three minutes prior to passing to the dryer in a continuous feed process.

The dryer can be a conventional fabric air dryer with forced air. The fabric can be unwound into the dye bath at a rate of one foot per minute in a continuous feed version of the batch process, as noted above.

Regarding the shoe/sock version of the embodiments, the socks are dyed to match the shoes by identifying a dye specification for shoe leather used in shoe tongues. Then, the dye specification for the shoe leather can be transmitted to a sock manufacturing site. A dye bath can be created using the dye specification of the shoe leather to identically match the tongues of shoes. Sock material is dyed in the dye bath. Sock pairs can be formed from the dyed sock material and, then, connected to the shoes to form a sock/shoe unit.

While these embodiments have been described with emphasis on the embodiments, it can be understood that within the scope of the appended claims, the embodiments might be practiced other than as specifically described herein.

What is claimed is:

1. A method for creating colored socks to identically match a suit, a trouser, and shoes, and for keeping the socks together with the suit, trouser, and shoes, the method consisting of the steps of:

a. identifying a dye specification;

b. dyeing a suit material, a slacks material, a shoe material and a sock material using the dye specification, consisting of the steps of:

i. mounting the sock material on a first hanger roller assembly for dyeing;

ii. mounting the suit material on a second hanger roller assembly;

iii. mounting the slacks material on a third hanger roller assembly;

iv. mounting the shoe material on a fourth hanger roller assembly;

v. unwinding and passing the sock material from the first hanger roller, the suit material from the second hanger roller assembly, the slacks material from the third hanger roller assembly, and the shoe material from the fourth hanger roller assembly through a common liquid dye bath at a rate of one foot of sock material per minute, a rate of one foot of suite material per minute, a rate of one foot of slacks material per minute, and a rate of one foot of shoe material per minute, wherein the common liquid dye bath comprises a solution of 80% water, 18% dye, and 2% fixers and additives to speed the dyeing;

vi. soaking the sock material, the suit material, the slacks material, and the shoe material in the liquid dye bath for a time ranging from one minute to three minutes such that the sock material, the suit material, the slacks material, and the shoe material are dyed to identically match, forming dyed material; and vii. using a continuous feed process to pass the dyed material through a dryer for drying;

c. creating a suit with the suit material, creating a sock pair with the sock material, creating a trouser with the slacks material, and creating a pair of shoes with the shoe material;

d. performing a member of the group consisting of:

i. connecting the sock pair to the suit to form an identically matching sock/suit unit;

ii. connecting the sock pair to the trouser to form an identically matching sock/trouser unit:

iii. connecting the sock pair to the pair of shoes to form an identically matching sock/shoes unit; or iv. combinations thereof;

e. attaching the dye specification with the suit, the trouser, and the pair of shoes;

f. including the dye specification with the suit, the trouser, and the pair of shoes for future ordering of additional sock pairs; and optionally transmitting the dye specification to a sock manufacturing site, a suit manufacturing site, a trouser manufacturer, or a shoe manufacturer for making an identical dye solution and dyeing additional apparel.

2. The method of claim 1, wherein the suit is a member of the group consisting of: a suit coat, pants, a vest, a sport coat, or combinations thereof.

3. The method of claim 1, wherein the suit is a safety suit and the sock pair is a safety sock pair.

4. The method of claim 1, wherein the sock pair is a nylon sock pair, a silk sock pair, a cotton sock pair, a wool sock pair, a cotton and wool blend sock pair, a nylon and cotton blend sock pair, or a silk and cotton blend sock pair.

5. The method of claim 1, wherein the trousers are dress trousers, tuxedo trousers, or suit trousers.

6. The method of claim 1, wherein the pair of shoes are dress shoes, business shoes, or casual shoes.

7. The method of claim 1, wherein the step of transmitting the dye specification to a sock manufacturing site, a suit manufacturing site, a trouser manufacturer, or a shoe manufacturer for making an identical dye solution and dyeing additional apparel is performed.

8. The method of claim 1, wherein the order form is:
a. inside a pocket of the suite;
b. inside a pocket of the trouser; and
c. inside one of the shoes of the pair of shoes for future sock ordering by a user.

9. The method of claim 1, wherein the dye specification is:
a. attached in a pocket of the suite;
b. attached inside one shoe of the pair of shoes; and
c. attached in a pocket of the trouser for future sock ordering by a user.

10. The method of claim 1, wherein the sock material and the suit material are between six feet long and eighteen feet long.

11. The method of claim 1, wherein the suit material is wool, nylon, polyester, silk, leather, cotton, cashmere, or combinations thereof.

12. The method of claim 1, wherein the common liquid dye bath is between fifty gallons and three hundred gallons.

13. A method for creating colored socks to identically match a suit, a trouser, and shoes, and for keeping the socks together with the suit, trouser, and shoes, the method consisting of the steps of:
a. identifying a dye specification;
b. dyeing a suit material, a slacks material, a shoe material, and a sock material using the dye specification, consisting of the steps of:
i. mounting the sock material on a first hanger roller assembly for dyeing;
ii. mounting the suit material on a second hanger roller assembly, wherein the suit material is wool, nylon, polyester, silk, leather, cotton, cashmere, or combinations thereof;
iii. mounting the slacks material on a third hanger roller assembly;
iv. mounting the shoe material on a fourth hanger roller assembly;
v. unwinding and passing the sock material from the first hanger roller, the suit material from the second hanger roller assembly, the slacks material from the third hanger roller assembly, and the shoe material from the fourth hanger roller assembly through a liquid dye bath;
vi. soaking the sock material, the suit material, the slacks material, and the shoe material in the liquid dye bath such that the sock material, the suit material, the slacks material, and the shoe material are dyed to identically match, forming dyed material; and
vii. passing the dyed material through a dryer for drying;
c. creating a suit with the suit material, wherein the suit is a member of the group consisting of: a suit coat, a vest, a sport coat, or combinations thereof;
d. creating a sock pair with the sock material, wherein the sock pair is a member of the group consisting of: a nylon sock pair, a silk sock pair, a cotton sock pair, a wool sock pair, a cotton and wool blend sock pair, a nylon and cotton blend sock pair, or a silk and cotton blend sock pair;
e. creating a trouser with the slacks material, wherein the trouser is a dress trouser, a tuxedo trouser, or a suit trouser;
f. creating a pair of shoes with the shoe material, wherein the pair of shoes are dress shoes, business shoes, or casual shoes;
g. performing a member of the group consisting of:
i. connecting the sock pair to the suit to form an identically matching sock/suit unit;
ii. connecting the sock pair to the trouser to form an identically matching sock/trouser unit:
iii. connecting the sock pair to the pair of shoes to form an identically matching sock/shoes unit; and
iv. combinations thereof;
h. attaching the dye specification with the suit, the trouser, and the pair of shoes; and
i. including the dye specification with the suit, the trouser, and the pair of shoes for future ordering of additional sock pairs.

14. The method of claim 13, wherein the dye specification is transmitted to a sock manufacturing site from a location where the suit, the trouser, and the pair of shoes are dyed, and wherein the sock material is dyed and the sock pair is created at a location different from where the suit, trouser, and pair of shoes are dyed and created.

15. A method for creating colored socks to identically match a suit, a trouser, or shoes, and for keeping the socks together with the suit, trouser, or shoes, the method consisting of the steps of:
a. identifying a dye specification;
b. dyeing a sock material and at least two materials selected from the group consisting of: a suit material, a slacks material, and a shoe material using the dye specification, consisting of the steps of:
i. mounting the sock material on a first hanger roller assembly for dyeing;
ii. mounting each of the at least two materials on at least one additional hanger roller assembly for dyeing;
iii. unwinding and passing the sock material from the first hanger roller assembly through a liquid dye bath;
iv. unwinding and passing each of the at least two materials from the at least one additional hanger roller assembly through the liquid dye bath;
v. soaking the sock material and the at least two materials in the liquid dye bath such that the sock material and the at least two materials are dyed to identically match each other, forming dyed material; and
vi. passing the dyed material through a dryer for drying;
c. creating a sock pair with the sock material, wherein the sock pair is a member of the group consisting of: a nylon sock pair, a silk sock pair, a cotton sock pair, a wool sock pair, a cotton and wool blend sock pair, a nylon and cotton blend sock pair, or a silk and cotton blend sock pair;
d. using the at least two materials to create at least two members of the group consisting of:
i. a suit, wherein the suit is a member of the group consisting of: a suit coat, a vest, a sport coat, or combinations thereof;
ii. a trouser, wherein the trouser is a dress trouser, a tuxedo trouser, or a suit trouser;
iii. a pair of shoes, wherein the pair of shoes are dress shoes, business shoes, or casual shoes;
e. connecting the sock pair to at least one of the at least two materials;
f. attaching the dye specification with the sock pair and the at least two materials; and
g. including the dye specification with the sock pair, the at least two materials, or combinations thereof for future ordering of additional sock pairs.

* * * * *